US005282539A

United States Patent [19]

Saathoff

[11] Patent Number: 5,282,539

[45] Date of Patent: Feb. 1, 1994

[54] GUN RACK

[76] Inventor: Ralph D. Saathoff, 2305 Trailridge Dr., Plano, Tex. 75074

[21] Appl. No.: 21,054

[22] Filed: Feb. 23, 1993

[51] Int. Cl.[5] ..... A47F 7/00

[52] U.S. Cl. ..... 211/64; 211/4; 70/58

[58] Field of Search ..... 211/64, 4, 87; 70/58

[56] References Cited

U.S. PATENT DOCUMENTS

| | | | |
|---|---|---|---|
| 2,710,100 | 6/1955 | Vermillion | 211/64 X |
| 2,958,423 | 11/1960 | Caloievo et al. | 211/64 X |
| 3,180,494 | 4/1965 | Levy | 211/64 |
| 4,139,100 | 2/1979 | Reed | 211/64 X |
| 4,624,372 | 11/1986 | Brolin | 211/64 X |
| 4,696,405 | 9/1987 | Waring | 211/64 X |

*Primary Examiner*—Robert W. Gibson, Jr.
*Attorney, Agent, or Firm*—Daniel V. Thompson

[57] ABSTRACT

A gun rack (80; 84) is provided for storing and displaying a plurality of firearms (68). The gun rack includes a substantially rectangular frame (10; 130) having a plurality of laterally spaced uprights (12 and 14; 132 and 134) and a plurality of vertically spaced crossbars (16, 18 and 20; 136, 138 and 140) spanning between the uprights. The frame is attachable to a vertical mounting surface, such as a wall. A relatively flat panel member (64; 178) is adapted for attachment to the frame, to substantially cover the frame and prevent the frame from being detached from the mounting surface. The frame further includes a plurality of first support pins (60) spaced vertically along one of the uprights and a plurality of second support pins (62) spaced vertically along the other upright. The support pins are adapted to support guns in a substantially horizontal position. First and second locking bars (84 and 86; 188 and 190) are secured to the frame (10; 130) by means of locking devices (100) to prevent removal of the guns mounted on the frame. The locking bars are positionable to cover respective end portions of the first and second support pins, thereby preventing removal of the guns. In one embodiment, the locking bars 188 and 190 have C-channel beams (200, 202, 204 and 206) projecting laterally from respective opposed ends of the locking bars for receiving the locking devices to prevent unauthorized access thereto.

8 Claims, 11 Drawing Sheets

GUN RACK

DESCRIPTION

1. Technical Field

This invention relates generally to racks for storing and displaying firearms and in particular to a gun rack with improved features for securing the guns stored therein against theft and unauthorized use.

2. Background Art

Firearms, including rifles, shot guns and handguns, are often stored and displayed on a rack. In some cases, the rack is attached directly to a wall or other vertical support surface. Guns are expensive and, of course, can be dangerous when used improperly. Therefore, it is advisable that guns be secured, when not in use, against theft and removal by unauthorized persons, such as children.

According to prior practice, gun racks typically include first and second laterally spaced uprights, each of which has a plurality of support members spaced along the corresponding upright for supporting a plurality of guns. A locking device is typically used to secure the guns in the rack. The rack is usually attached to a wall by mounting screws.

One type of gun rack, as shown in U.S. Pat. No. 4,139,100, features a vertical row of C-clamp gun barrel supports on one upright and a vertical row of pins projecting from the other upright. Each pin is extendable through an opening in the trigger guard of a gun mounted thereon and through an aperture in a vertical locking bar. The locking bar is secured to the corresponding upright by a padlock at the top of the bar.

A major problem associated with prior art gun racks is the difficulty in securing the guns against theft and removal by unauthorized persons. A padlock, such as that used in the aforementioned U.S. Pat. No. 4,139,100, can be easily cut by a thief or other intruder. Furthermore, the entire rack is usually removable by simply detaching the mounting screws from the wall on which the rack is mounted. There is therefore a need for a gun rack with improved security features for securing the guns stored in the rack against theft and unauthorized removal.

DISCLOSURE OF INVENTION

According to the present invention, a gun rack includes a frame having gun barrel support means and gun trigger guard receiving means projecting from the frame for supporting a gun in a substantially horizontal position. The gun rack further includes mounting means for mounting the frame with a vertical mounting surface, such as a wall, first securing means projecting from the frame and second securing means engageable with the first securing means in locking engagement, to inhibit removal of the gun from the rack.

In accordance with one unique feature of the invention, the first securing means includes a hollow member having first and second holes in respective opposed sides thereof. The second securing means is comprised of an elongated member having a lug projecting laterally therefrom. The lug has third and fourth holes in respective opposed sides thereof and is telescopically receivable within the hollow member, with the respective first, second, third and fourth holes in transverse axial alignment for receiving a hasp of a locking device, whereby the lug and hollow member are securable together in locking engagement.

In accordance with another unique feature of the invention, a projecting member projects laterally from at least one end of the elongated member. The projecting member has opposed side walls defining a channel for receiving the hollow member when the lug is telescoped within the hollow member. A locking device used to secure the lug within the hollow member is substantially completely received with the channel thereby inhibiting access to the locking device. In one embodiment, the projecting member has apertures in the respective side walls to accommodate the hasp portion of the locking device through one aperture and the body portion of the locking device through the other aperture.

In accordance with yet another feature of the invention, a panel member is mountable with the frame to substantially cover the frame and inhibit access to the mounting means. The panel member has respective openings to accommodate the passage of the gun barrel support means, the trigger guard receiving means and the first securing means through the panel member when the panel member is mounted with the frame. The locking engagement between the first and second securing means retains the panel member mounted with the frame. When the panel member is mounted with the frame, access to the mounting means is inhibited, thereby inhibiting removal of the frame from the vertical mounting surface.

Figure 4:
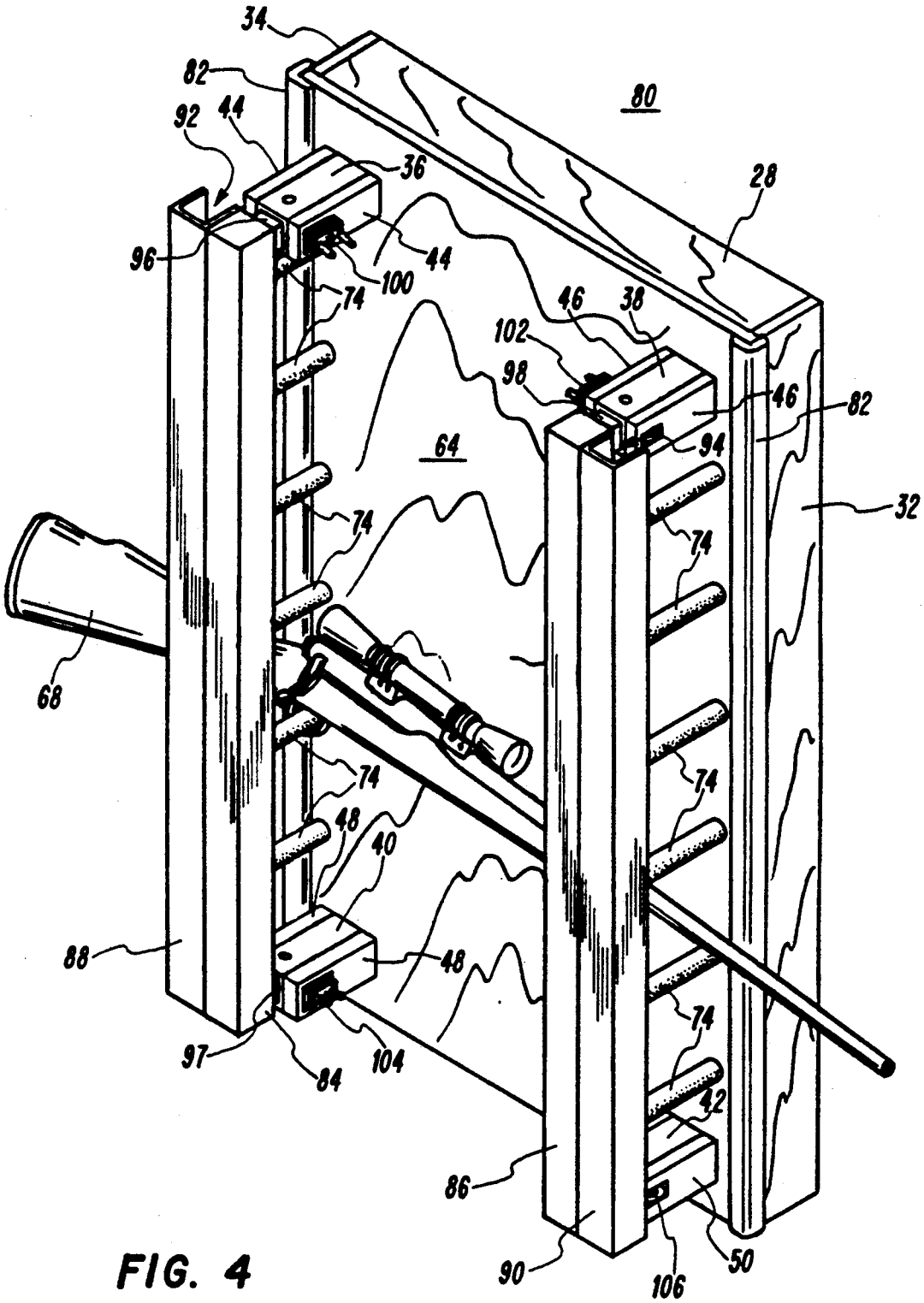
FIG. 4 is a perspective view of a fully assembled gun rack, according to the present invention, showing a gun mounted on the rack.
Figure 7:
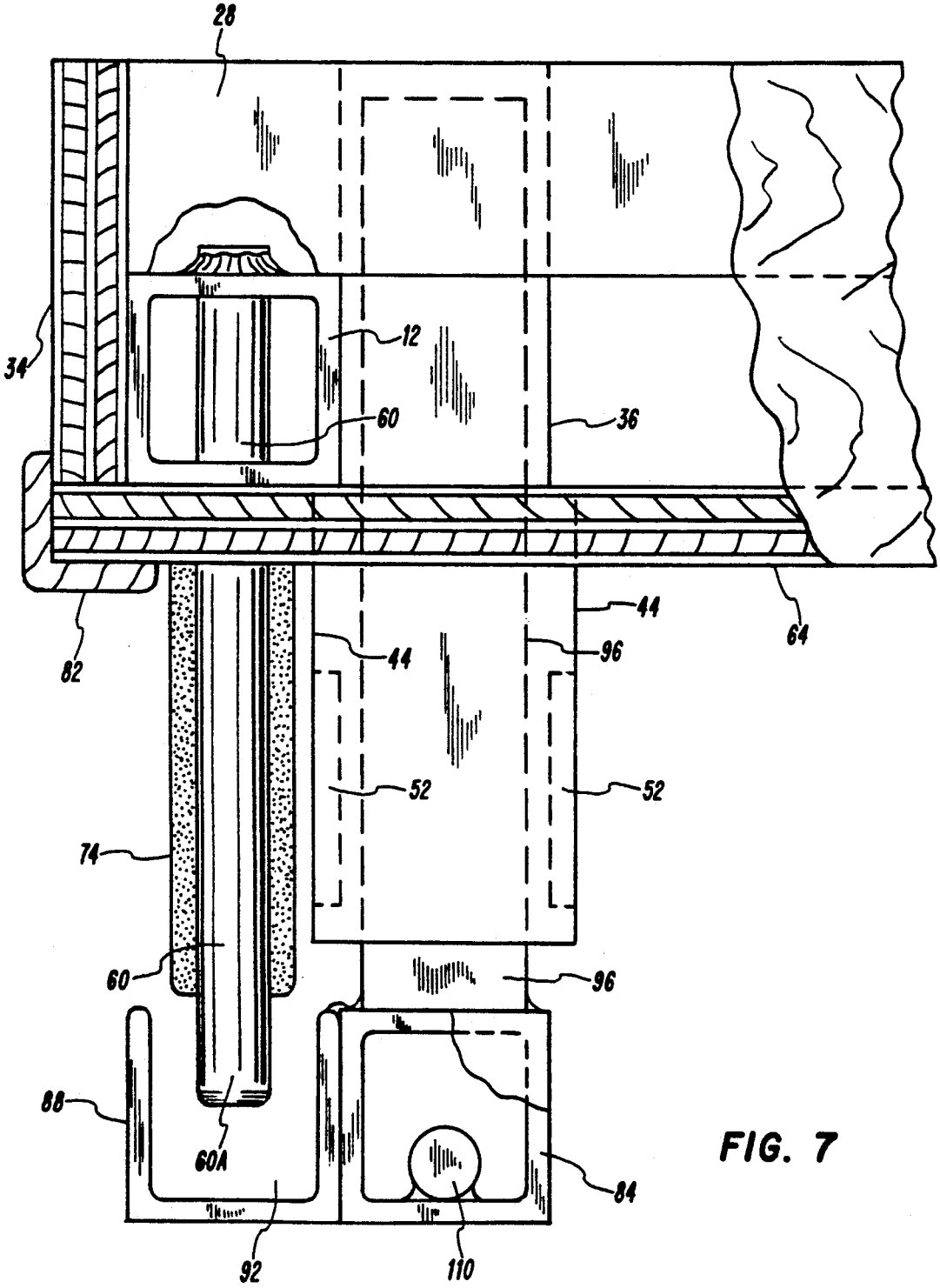
Figure 8:
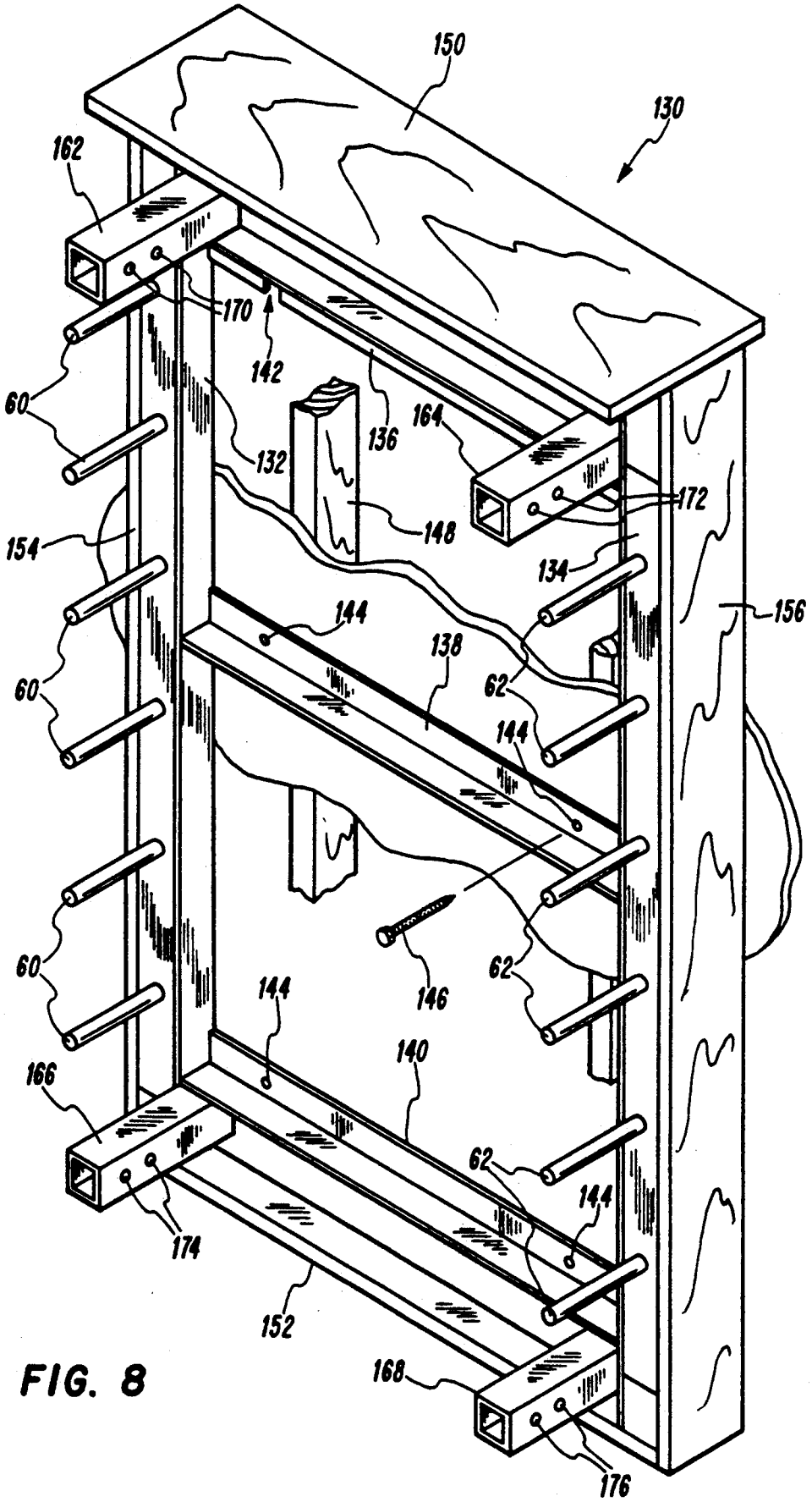
Figure 9:
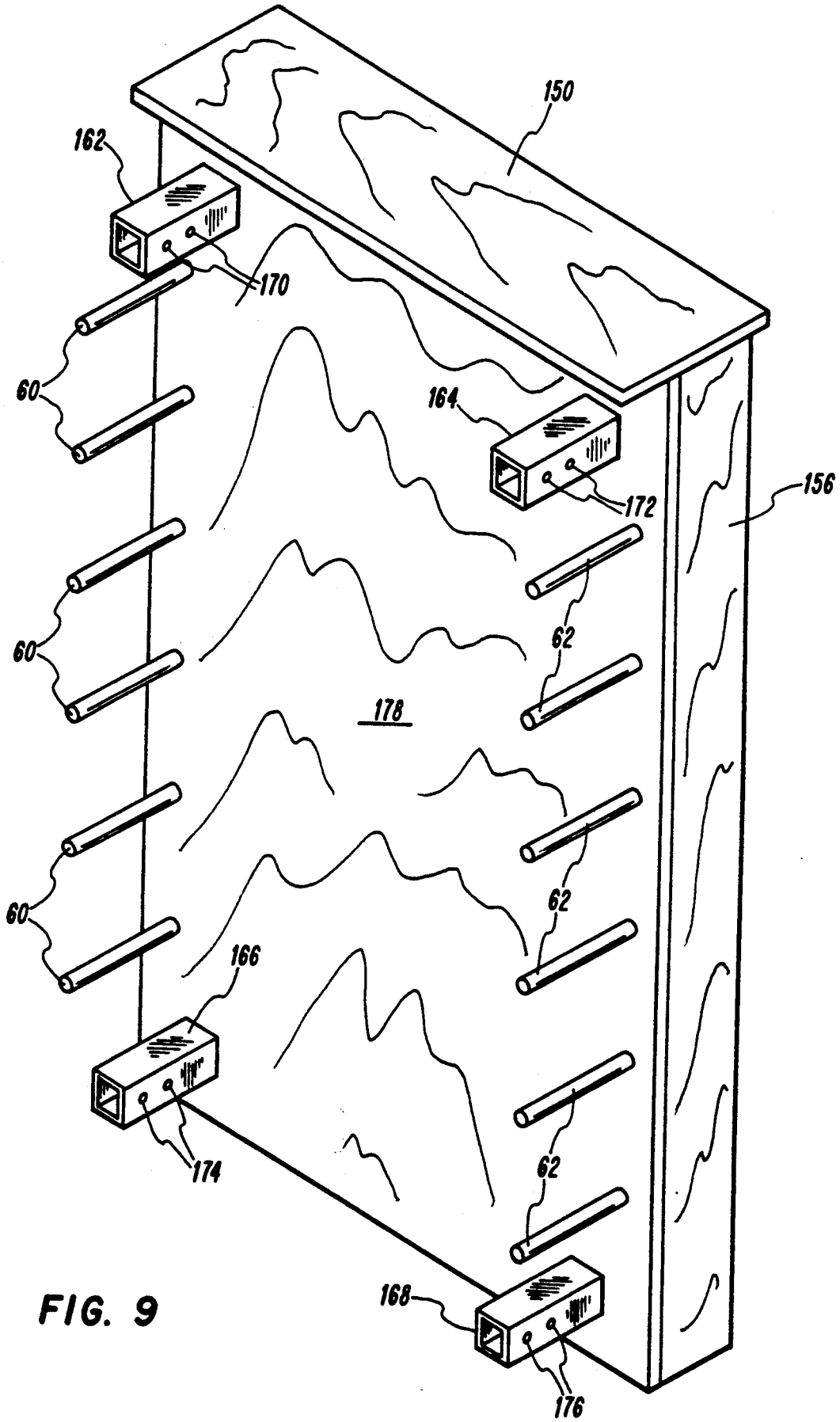
Figure 10:
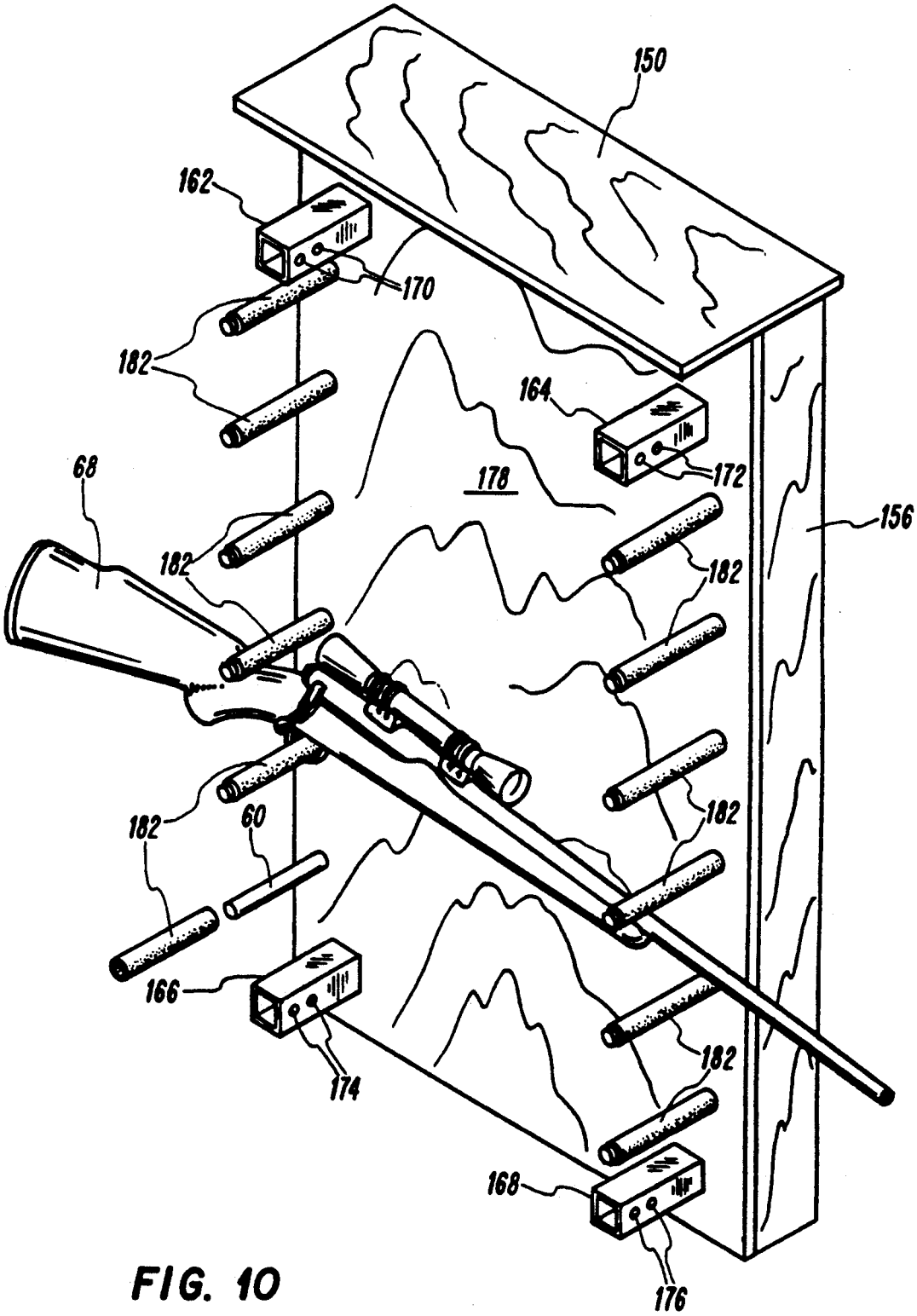
Figure 11:
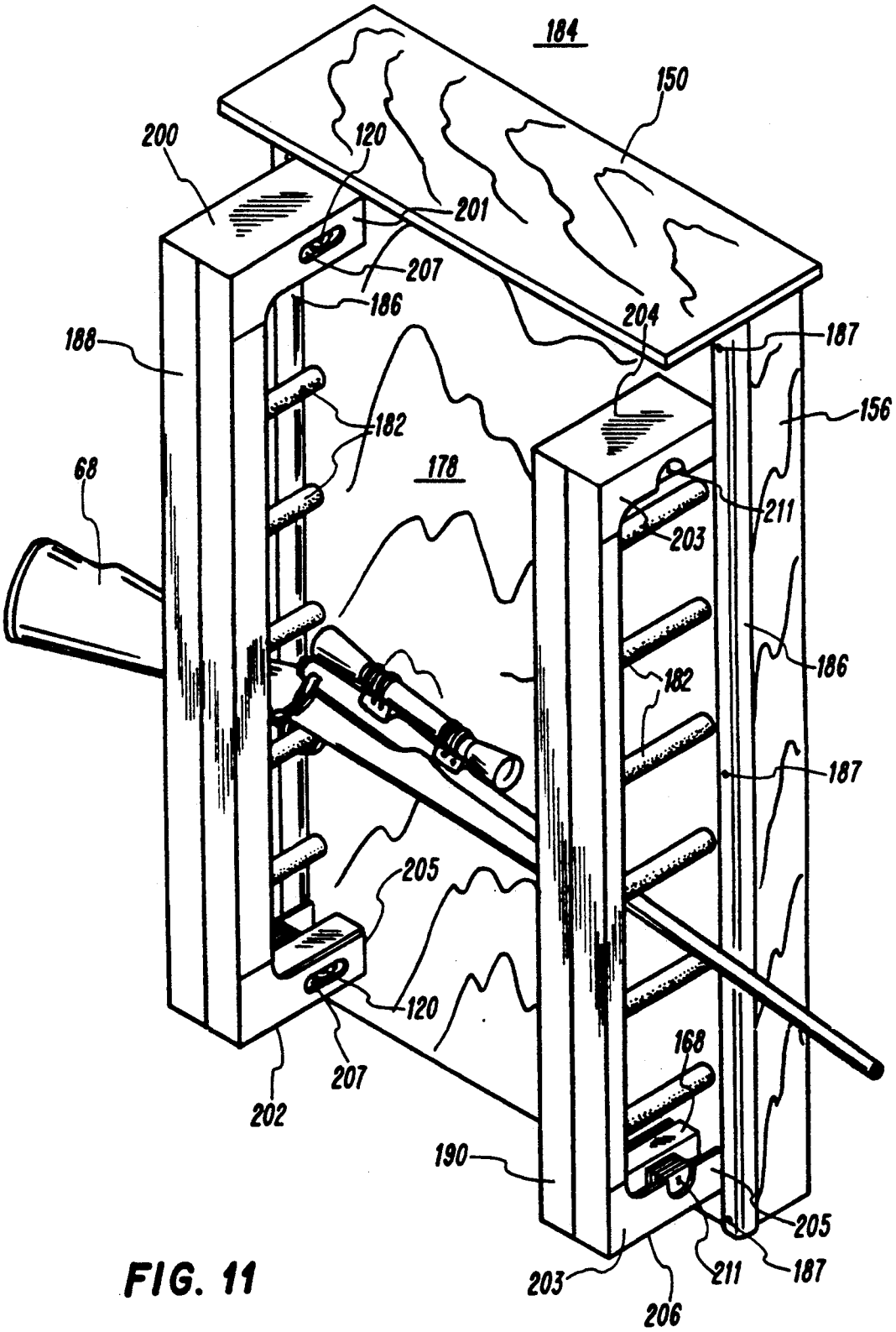

FIG.'s 5 and 6 are detailed perspective views, illustrating a locking mechanism for securing guns mounted on the rack of FIG. 4 against theft and unauthorized removal;

FIG. 7 is a top plan view of the locking mechanism of FIG.'s 5 and 6, with a portion thereof broken away;

FIG. 8 is a perspective view of a frame portion of an alternate embodiment of a gun rack, according to the present invention;

FIG. 9 is a perspective view of the frame portion of FIG. 8, with a panel member attached to the frame portion;

FIG. 10 is a perspective view of the frame portion and panel member of FIG. 9, showing a gun mounted thereon;

FIG. 11 is a perspective view of an alternate embodiment of a fully assembled sun rack, according to the present invention, showing a gun mounted on the rack; and FIG.'s 12 and 13 are detailed perspective views, illustrating a locking mechanism for securing guns mounted on the rack of FIG. 11 against theft and unauthorized removal.

BEST MODE FOR CARRYING OUT THE INVENTION

In the description which follows, like parts are marked throughout the specification and drawings with the same respective reference numerals. The drawings are not necessarily to scale and in some instances proportions may have been exaggerated in order to more clearly depict certain features of the invention.

Figure 1:
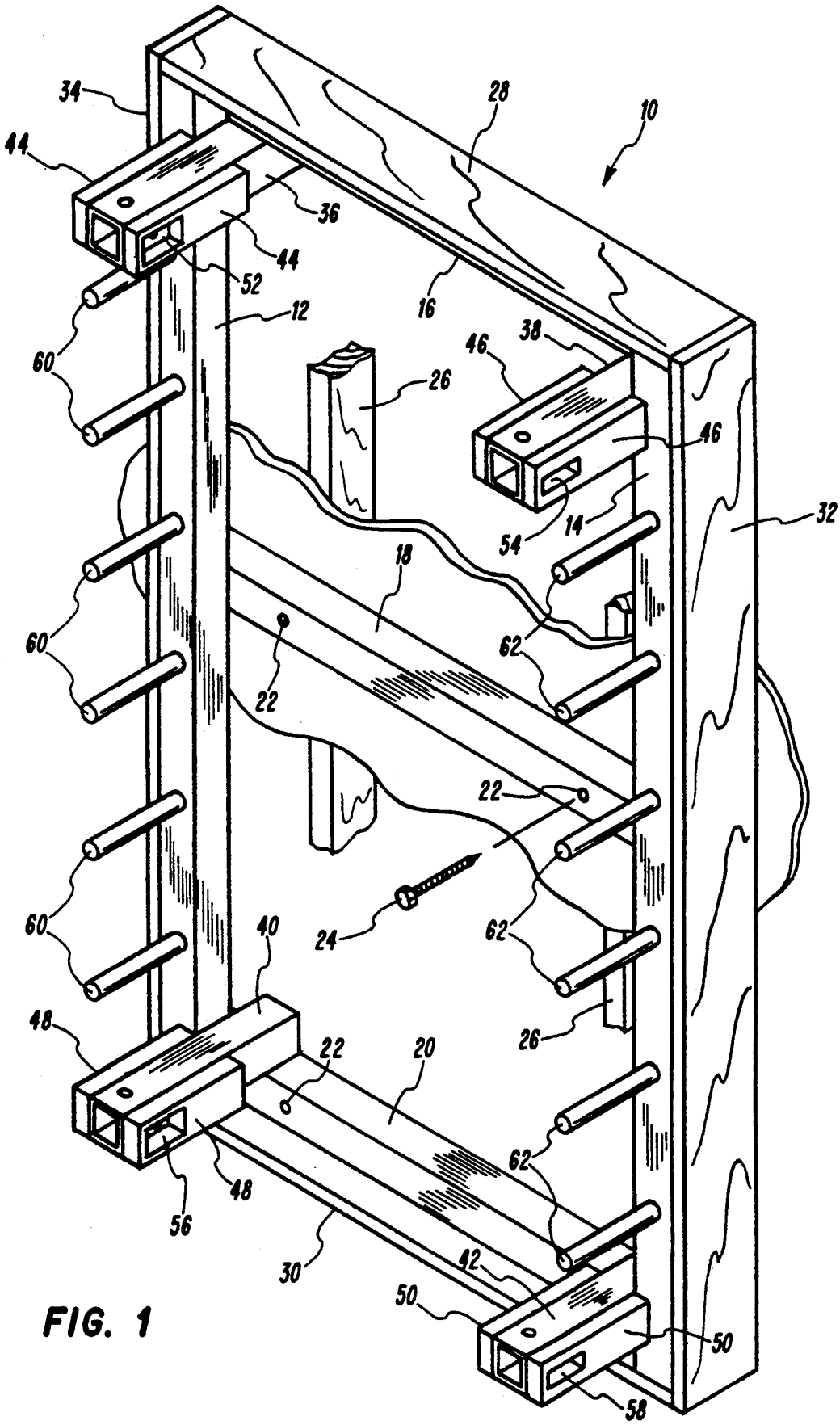
FIG. 1 is a perspective view of a frame portion of a gun rack, according to the present invention.

Referring to FIG. 1, a rack for storing firearms includes a substantially rectangular frame 10, which is comprised of a pair of laterally spaced uprights 12 and 14 and three vertically spaced crossbars 16, 18 and 20 spanning between uprights 12 and 14. Each crossbar 16, 18 and 20 has a plurality of apertures 22, each of which is adapted to receive a threaded bolt 24 (one of which is shown in FIG. 1). Bolts 24 are adapted to penetrate into respective wall studs 26, to fasten frame 10 to a vertical mounting surface, such as a wall. Uprights 12 and 14 and crossbars 16, 18 and 20 are preferably made of a square stock steel material. Respective plywood facings define top, bottom and opposed side panels 28, 30, 32 and 34, respectively, of frame 10. Upright 12 as a plurality of vertically spaced metal support pins 60 projecting outwardly therefrom. Similarly, upright 14 has a plurality of vertically spaced metal support pins 62 projecting outwardly therefrom.

Four hollow members 36, 38, 40 and 42 are located adjacent respective four corners of rectangular frame 10. Hollow members 36 and 38 are preferably attached by welding to crossbar 16 and hollow members 40 and 42 are preferably attached by welding to crossbar 20. Hollow members 36, 38, 40 and 42 are also preferably made of square stock steel material. Hollow members 36, 38, 40 and 42 have respective pairs of metal blocks 44, 46, 48 and 50 mounted on respective opposed sides of the respective hollow members 36, 38, 40 and 42. Blocks 44, 46, 48 and 50 are preferably made of steel material. Blocks 44, 46, 48 and 50 have respective openings. The openings in blocks 44 define respective opposed recesses 52 on the sides of hollow member 36. The openings in blocks 46 define respective opposed recesses 54 on the sides of hollow member 38. The openings in blocks 48 define respective opposed recesses 56 on the sides of hollow member 40. The openings in blocks 50 define respective opposed recesses 58 on the sides of hollow member 42. The function of recesses 52, 54, 56 and 58 will be described in greater detail hereinafter. Blocks 44, 46, 48 and 50 are also preferably made of steel material.

Figure 2:
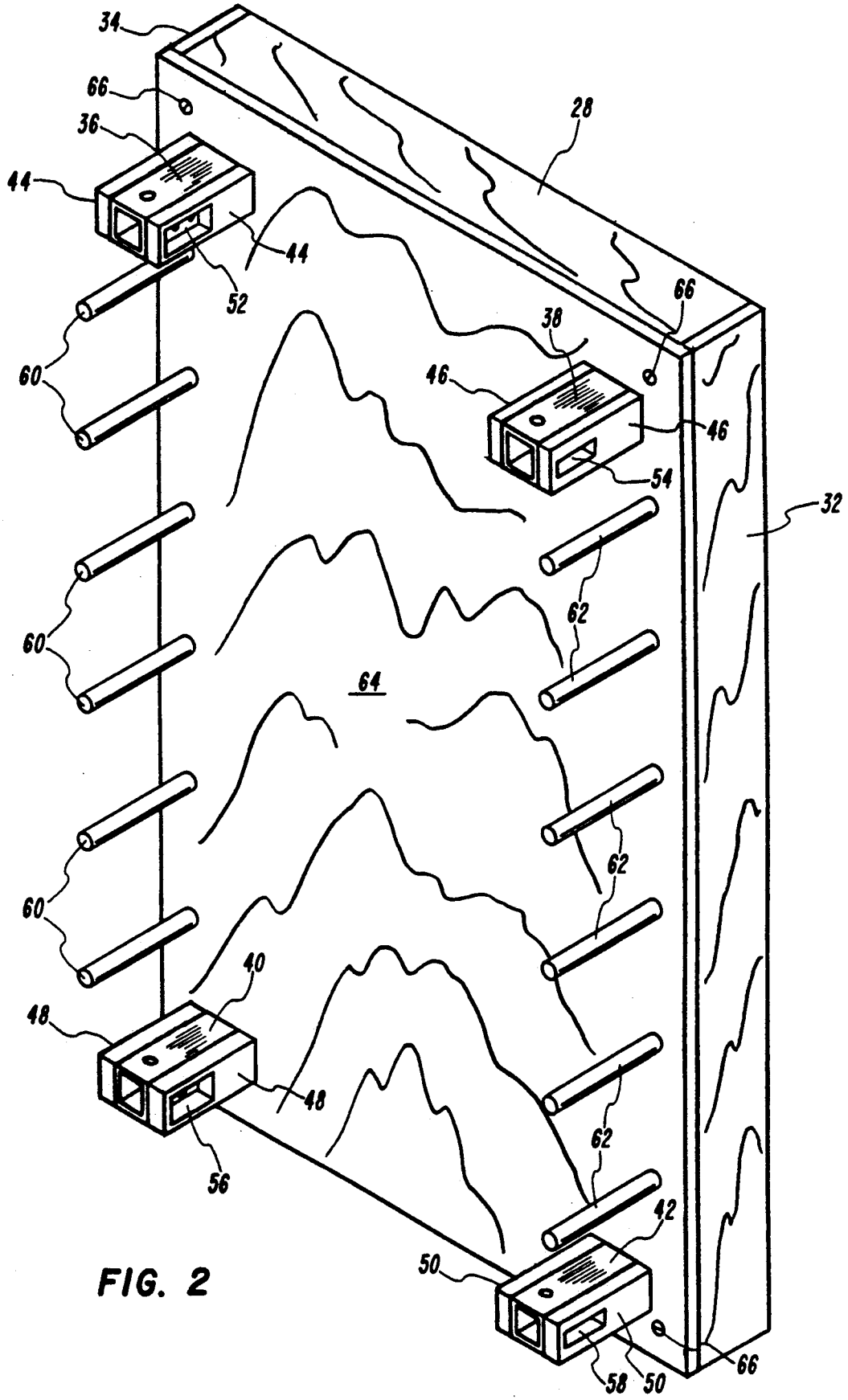
FIG. 2 is a perspective view of the frame portion of FIG. 1, with a panel member attached to the frame portion.

Referring also to FIG. 2, a relatively flat, rectangular plywood panel member 64 is attached, preferably by mounting screws 66, to the wood panels of frame 10, such that panel member 64 cooperates with wood panels 28, 30, 32 and 34 to substantially cover uprights 12 and 14 and crossbars 16, 18 and 20. When panel member 64 is secured to frame 10, as shown in FIG. 2, access to mounting bolts 24 is substantially inhibited, so that one cannot detach frame 10 from the wall on which it is mounted without first removing panel member 64 from frame 10. Panel member 64 has openings to accommodate the passage of hollow members 36, 38, 40 and 42, and support pins 60 and 62 therethrough.

Figure 3:
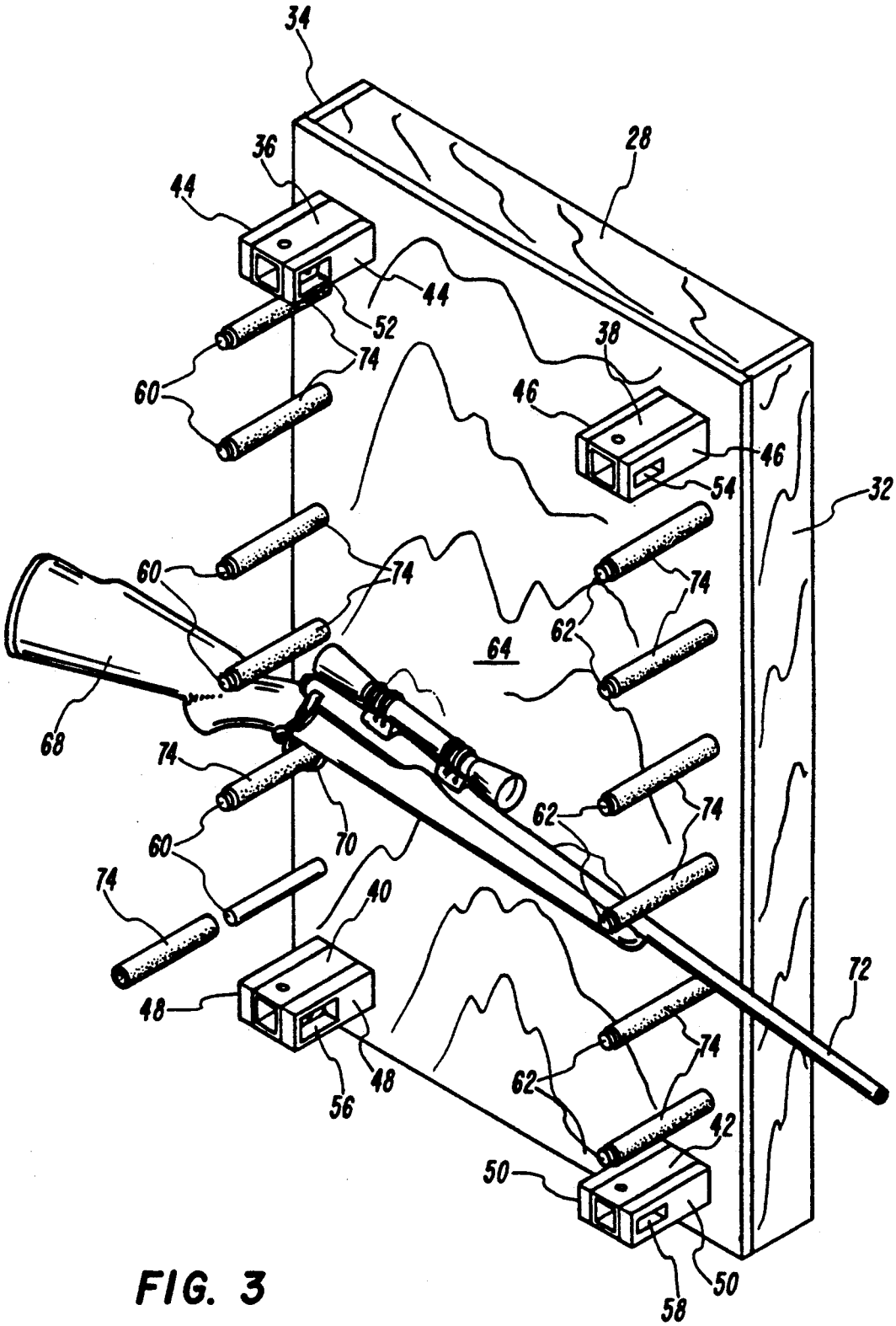
FIG. 3 is perspective view of the frame portion and panel member of FIG. 2, showing a gun mounted thereon.

Referring also to FIG. 3, each support pin 60 is adapted to cooperate with a support pin 62 which is laterally disposed with respect to the corresponding support pin 60, for supporting a gun, such as the rifle 68 shown in FIG. 3, in a substantially horizontal position. One of the cooperating pair of pins 60, 62 is adapted to extend through the trigger guard 70 of rifle 68, while the other pin 60, 62 is adapted to support the barrel 72 of rifle 68. In FIG. 3, one of the support pins 60 extends through trigger guard 70, while one of the support pins 62 supports barrel 72. One skilled in the art will appreciate, however, that rifle 68 can be rotated 180°, such that support pin 62 would extend through trigger guard 70 and support pin 60 would support barrel 72. To prevent damage from metal to metal contact, each support pin 60, 62 preferably includes a rubber sleeve 74 positioned in concentric relationship about the corresponding pin 60, 62.

Referring now to FIG. 4, a gun rack 80, according to the present invention, is shown fully assembled and in a locked condition for securing rifle 68 within rack 80. Elongated wooden strips 82 are provided for covering the abutting edges of front panel member 64 and the respective wooden side panels 32 and 34. Two elongated locking bars 84 and 86, which are also preferably made of square stock steel material, are provided for securing gun 68 within rack 80. Elongated beams 88 and 90 are mounted against the respective bars 84 and 86. Beams 88 and 90 are preferably made of steel material. Beam 88 extends substantially the entire length of bar 86. Beam 88 has an elongated substantially U-shaped channel 92, which is positionable in facing relationship with front panel member 64. Similarly, beam 90 has an elongated, substantially U-shaped channel 94, which is also positionable in facing relationship with front panel member 64, as shown in FIG. 4.

Each bar 84, 86 has a lug projecting therefrom adjacent each end of the corresponding bar 84, 86. In FIG. 4, lugs 96 and 97 are shown projecting from respective upper and lower ends of bar 84 and lug 98 is shown projecting from an upper end of bar 86. The bottom lug of bar 86 is not visible in FIG. 4. In FIG. 4, the four lugs are telescopically received within the respective hollow members 36, 38, 40 and 42. Lug 96 is telescopically received within hollow member 36, lug 97 is telescopically received within hollow member 40 and lug 98 is telescopically received within hollow member 38. Although not shown in FIG. 4, the lug projecting from the lower end of bar 86 is telescopically received within hollow member 42. The four lugs are secured in mating engagement with the respective hollow members 36, 38, 40 and 42 by means of respective locking devices 100, 102, 104 and 106.

Referring also to FIG.'s 5–7, the locking engagement between the respective lugs and the hollow members 36, 38, 40 and 42 is illustrated in greater detail. For purposes of illustration, the engagement between the lug 96 and hollow member 36 will be described with reference to FIG.',s 5–7. One skilled in the art will appreciate, however, that the locking engagement between the other three lugs and the respective other three hollow members 38, 40, 42 is essentially the same.

Figure 5:
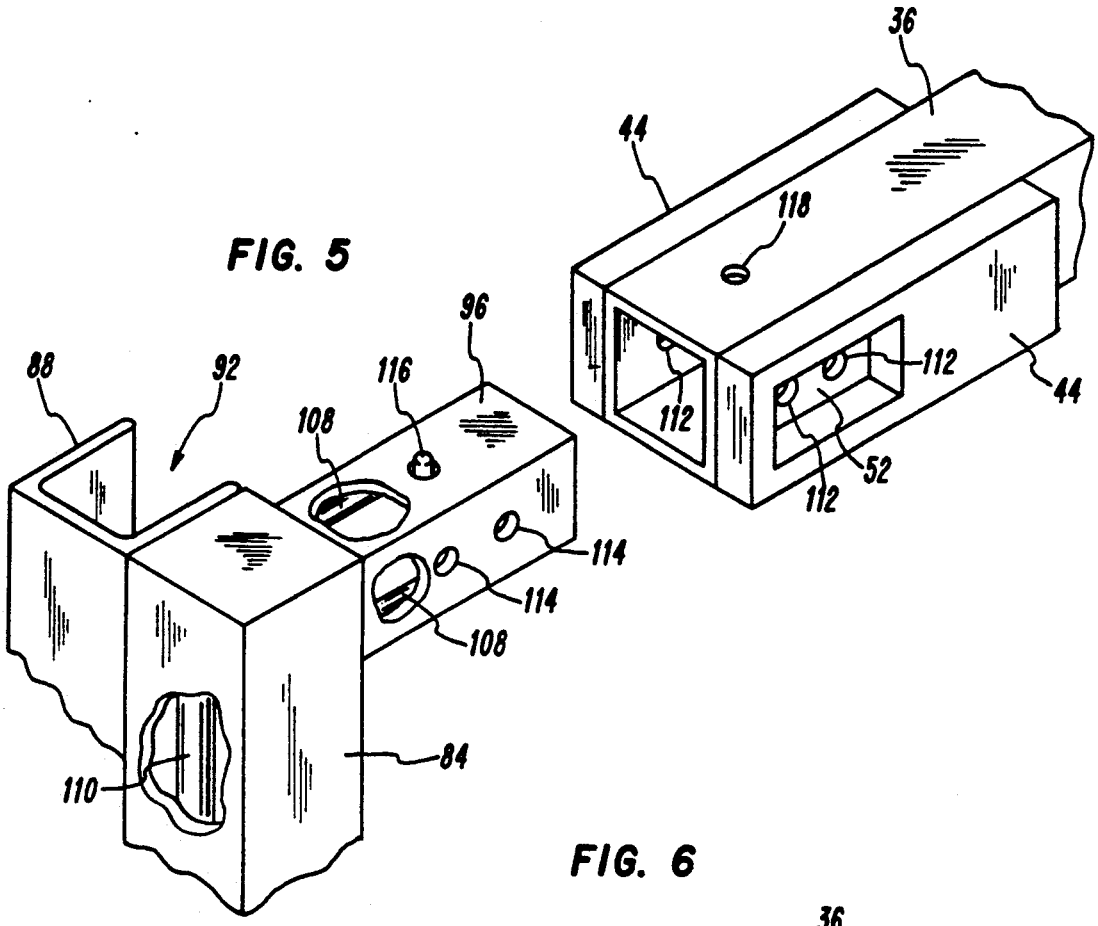

As shown in FIG. 5, lug 96 is preferably made of square stock steel material. One or more case hardened steel reinforcing shafts 108 are located in the interior of lug 96 to enhance the resistance of lug 96 to being cut. Bar 84 also preferably includes at least one reinforcing shaft 110, which extends substantially along the entire length of bar 84, for enhancing the resistance of bar 84 to being cut. Shafts 108 and 110 enhance the security of the gun rack.

Hollow member 36 has a pair of holes 112 in each side thereof, located within the corresponding recess 52.

Lug 96 also has a pair of holes 114 on each side thereof. Lug 96 is telescopically receivable within hollow member 36 such that each of the holes 114 is aligned in transverse axial alignment with a corresponding hole 112.

Figure 6:
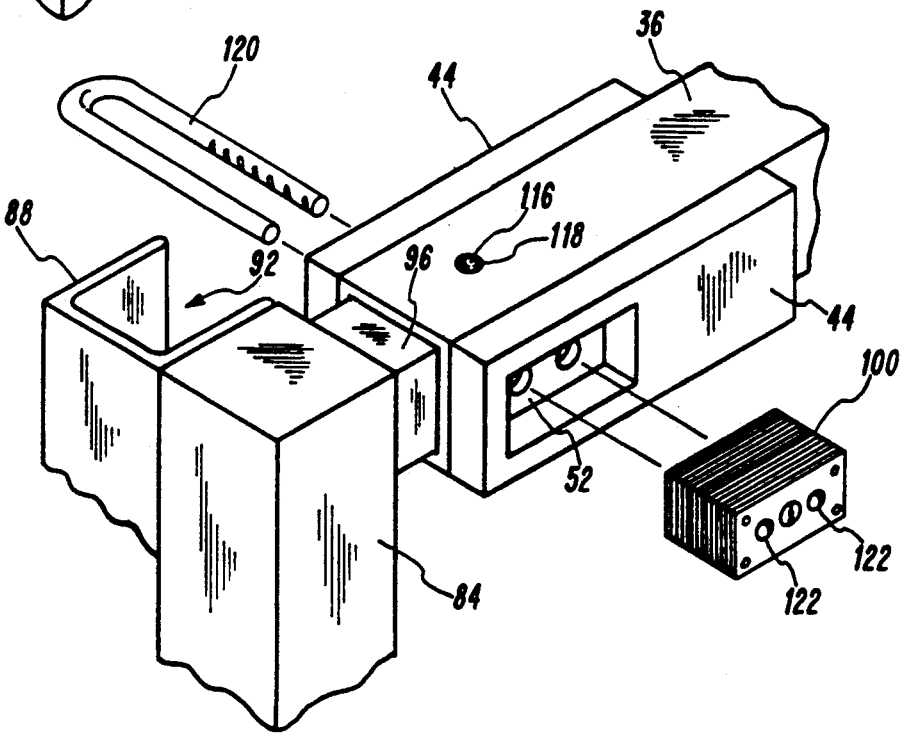

A resilient detent 116 extends through a top opening in lug 96. Detent 116 is adapted to extend through a top opening 118 in hollow member 36 when holes 114 are properly aligned with the respective holes 112, such that the mating engagement between detent 116 and the top opening 118 serves to locate lug 96 longitudinally within hollow member 36. FIG. 6 shows lug 96 received within hollow member 36 and detent 116 in mating engagement with top opening 118. When lug 96 is received within hollow member 36, holes 114 are aligned in transverse axial alignment with the respective holes 112, such that the aligned holes 114, 112 are adapted to receive a substantially U-shaped hasp 120 of locking device 100. Locking device 100 is preferably a key-operable lock. The arms of hasp 120 are adapted to extend through the aligned sets of openings 114 and 112 and into locking device 100, such that the arms of hasp 120 extend through rear openings 122 of locking device 100, as can be best seen in FIG. 4. When locking device 100 is locked, lug 96 is secured in locking engagement with hollow member 36.

As can be best seen in FIG. 4, one of the recesses 52 is adapted to receive at least a portion of lock 100, while the other recess 52 is adapted to receive at least a portion of hasp 120. Locating portions of lock 100 and hasp 120 within the respective recesses 52 makes lock 100 less resistant to tampering.

Referring now to FIG. 7, when lug 96 is received within hollow member 36, as shown in FIG. 6, a distal end portion 60*a* of each support pin 60 extends into channel 92 of beam 88, to substantially inhibit access to the respective distal end portions 60*a* of support pins 60. Beam 88 effectively serves as a guard to cover the respective ends of support pins 60, to prevent the guns mounted on the rack from being removed from the rack by sliding the guns off the ends of the pins 60. When lug 96 is received within hollow member 36, lug 97 is also received within hollow member 40. Similarly, as shown in FIG. 4, when lug 98 is in mating engagement with hollow member 38 and the bottom lug of bar 86 is in mating engagement with hollow member 42, respective distal end portions of support pins 62 are received within channel 94 of beam 90, to substantially inhibit access to the respective distal end portions of pins 62, such that the guns stored on the rack cannot removed therefrom by sliding the guns off the ends of support pins 62. Pins 62 are also preferably made of case hardened steel, which increases their resistance to being cut.

When gun rack 80 is fully assembled and secured, as shown in FIG. 4, a plurality of guns 68 may be mounted in substantially horizontal positions, with each gun 68 being supported by a cooperating pair of support pins 60 and 62. Locking devices 100, 102, 104 and 106 secure beams 84 and 86 in a substantially vertical orientation, with the corresponding beams 88 and 90 positioned to receive the respective distal end portions of the respective support pins 60 and 62. Therefore, a gun 68 mounted on rack 80 cannot be removed therefrom by sliding gun 68 off the ends of the corresponding support pins 60 and 62 without disengaging the lugs from the respective hollow members 36, 38, 40 and 42. Disengagement cannot be readily accomplished by cutting the locking devices because substantial portions of each of the locking devices are received within the corresponding recesses on the sides of the hollow members and are therefore not readily accessible. Nor can the lugs be readily disengaged from the hollow members by cutting the respective lugs because when the lugs are received within the respective hollow members, only a small portion of each lug protrudes therefrom. Furthermore, the steel reinforcing shafts 108 (see FIG. 5) resist cutting of the lugs.

As previously mentioned, support pins 60 and 62 are functionally interchangeable, such that both sets of pins 60 and 62 are adapted to extend through the trigger guard 70 of a gun 68 and to support the barrel 62 of gun 68. One skilled in the art will appreciate that it is the pin which extends through the trigger guard 70 which actually retains gun 68 on the rack 80. Therefore, it may be advantageous to mount some of the guns stored on rack 80 with the respective gun barrels pointed to the right, as shown in FIG. 4, and others of the guns with their gun barrels pointed in the opposite direction. In this configuration, some of the guns will be retained on rack 80 by support pins 60, while others of the guns will be retained on rack 80 by support pins 62. This configuration not only makes it more difficult for an intruder to steal all of the guns, which would require removal of both locking bars 84 and 86, but also allows the rack to be used by two different owners or custodians.

For example, as shown in FIG. 4, the guns supported on rack 80 with support pins 60 extending through the respective trigger guards of the guns can be removed from rack 80 by unlocking devices 100 and 104, to disengage locking bar 84. The other guns, which are stored with their gun barrels in the opposite direction, with support pins 62 extending through the respective trigger guards of the guns, can be removed from rack 80 by operating locking devices 102 and 106, to disengage locking bar 86. One set of keys can be used by a person to unlock devices 100 and 104, while another set of keys can be used by another person to unlock locking devices 102 and 106.

Referring to FIG. 8, a rack for storing firearms includes a substantially rectangular frame 130, which is comprised of a pair of laterally spaced uprights 132 and 134 and three vertically spaced crossbars 136, 138 and 140 spanning between uprights 132 and 134. Top crossbar 136 has a pair of substantially U-shaped apertures 142 (only one of which is shown in FIG. 8), to allow frame 130 to be temporarily suspended from a vertical mounting surface, such as a wall. Intermediate and lower crossbars 138 and 140 each have a pair of circular apertures 144. Apertures 142 and 144 are adapted to receive respective bolts 146 (one of which is shown in FIG. 8). Bolts 146 are adapted to penetrate into respective wall studs 148 (one of which is shown in FIG. 8), to fasten frame 130 to a vertical mounting surface, such as a wall. Crossbars 136, 138 and 140 are preferably steel angle irons.

Respective solid wood facings define top, bottom and opposed side panels 150, 152, 154 and 156, respectively, of frame 130. Upright 132 has a plurality of vertically spaced case hardened steel support pins 60 projecting outwardly therefrom and upright 134 has a plurality of vertically spaced case hardened steel support pins 62 projecting outwardly therefrom.

Four hollow members 162, 164, 166 and 168 are located adjacent respective four corners of rectangular frame 130. Hollow members 162 and 164 are preferably attached by welding to top crossbar 136 and hollow members 166 and 168 are preferably attached to bottom crossbar 140. Hollow members 162, 164, 166 and 168 are also preferably made of square stock steel material.

Hollow member 162 has a pair of holes 170 in each side thereof (only one pair being shown in FIG. 8). Hollow member 164 has a pair of holes 172 in each side thereof (only one pair being shown in FIG. 8). Hollow member 166 has a pair of holes 174 in each side thereof (only one pair being shown in FIG. 8). Hollow member 168 has a pair of holes 176 in each side thereof (only one pair being shown in FIG. 8).

Referring also to FIG. 9, a relatively flat, rectangular plywood panel member 178 is positioned in facing relationship with frame 130, such that panel member 178 cooperates with panels 150, 152, 154 and 156 to substantially cover uprights 132 and 134 and crossbars 136, 138 and 140. When panel member 178 is positioned as shown in FIG. 9, access to mounting bolts 146 is substantially inhibited, so that one cannot detach frame 130 from the wall on which it is mounted without first removing panel member 178 from frame 130. Panel member 178 has openings to accommodate the passage of hollow members 162, 164, 166 and 168, and support pins 60 and 62 therethrough.

Referring also to FIG. 10, each support pin 60 is adapted to cooperate with a support pin 62 which is laterally disposed with respect to the corresponding support pin 158, for supporting a gun, such as rifle 68, in a substantially horizontal position. To prevent damage from metal to metal contact, each support pin 60, 62 preferably includes a rubber sleeve 182 positioned in concentric relationship about the corresponding pin 60, 62.

Referring now to FIG. 11, a gun rack 184, according to the present invention, is shown fully assembled and in a locked condition for securing gun 68 within rack 184. Elongated wooden strips 186 are provided for covering the abutting edges of front panel member 178 and the respective wooden side panels 154 and 156. Mounting screws 187 are preferably used to secure strips 186 and panel member 178 to side panels 154 and 156. Two elongated locking bars 188 and 190, which are also preferably made of square stock steel material, are provided for securing gun 68 within rack 184.

As can be best seen in FIG.'s 12 and 13, each bar 188, 190 has a lug 192 projecting therefrom adjacent each end of the corresponding bar 188, 190. The four lugs are telescopically received within the respective hollow members 162, 164, 166 and 168.

Figure 12:
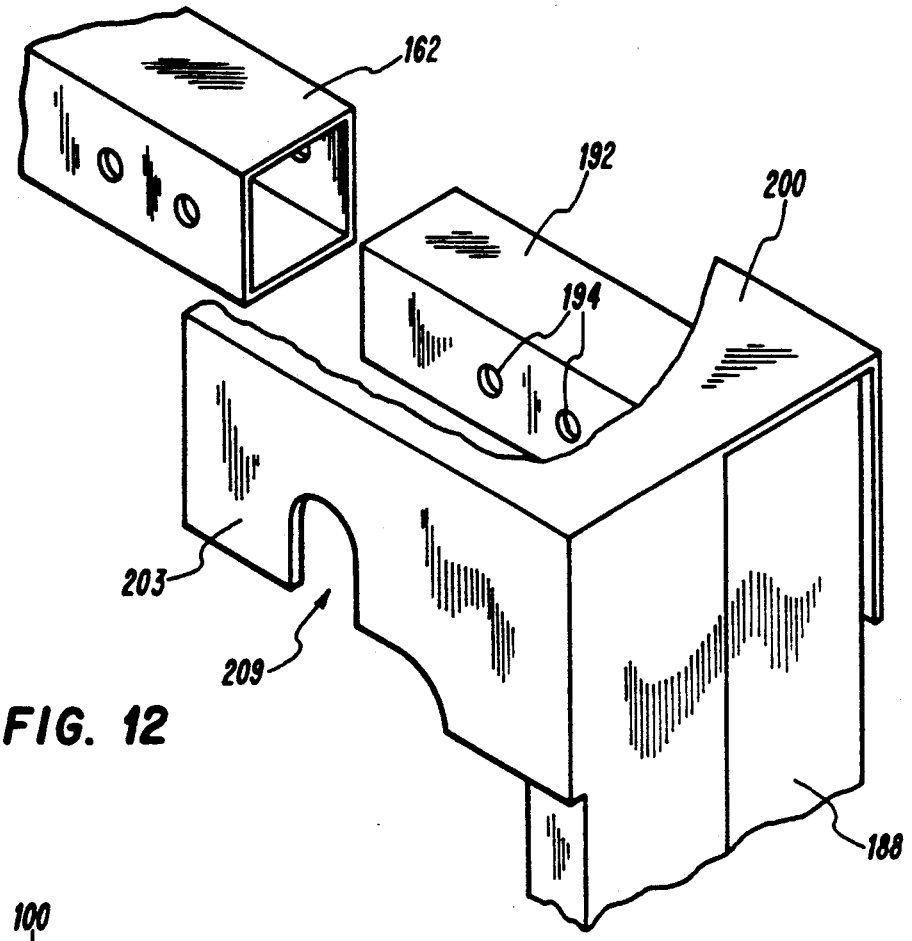
Figure 13:
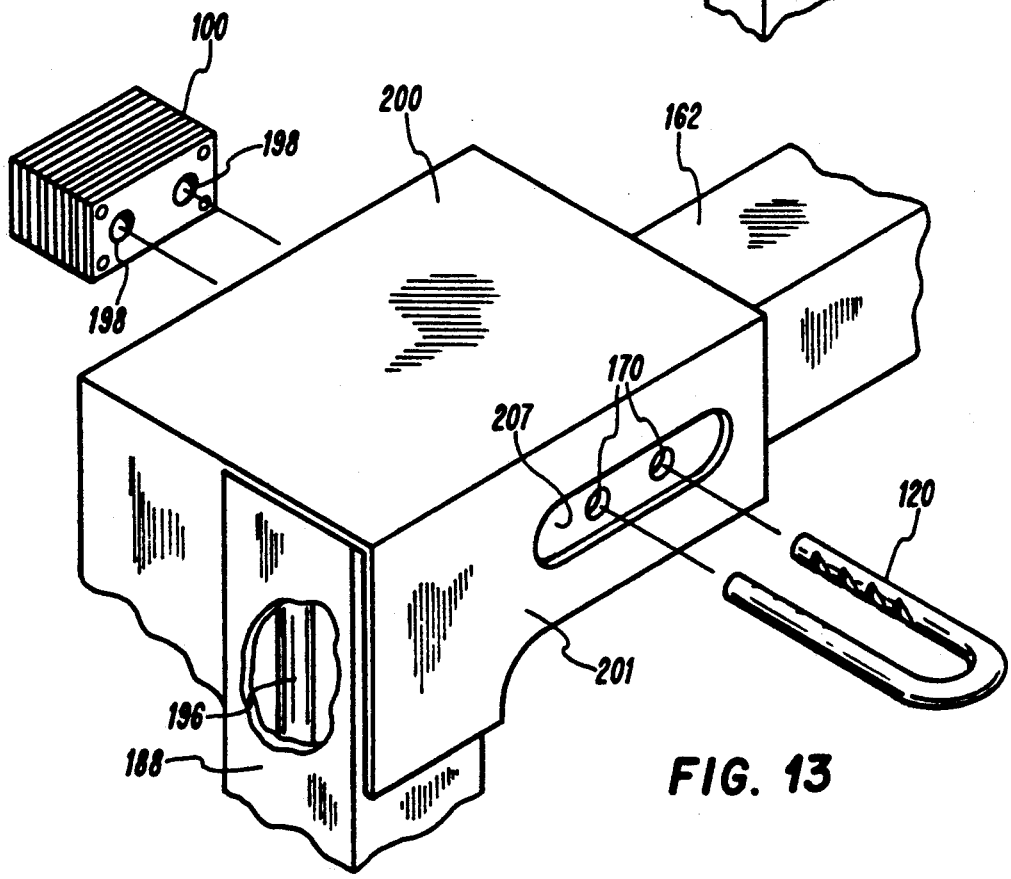

Lug 192, which projects from the upper end of bar 188, is shown in FIG. 12. Each lug 192 has a pair of holes 194 on each side thereof. Lug 192 is telescopically receivable within hollow member 162 such that each of the holes 194 is aligned in transverse axial alignment with a hole in the corresponding hollow member. In FIG. 12, lug 192 is depicted before it is inserted into hollow member 162. In FIG. 13, lug 192 is telescopically received within hollow member 162. One skilled in the art will appreciate that the locking engagement between the other lug 192 projecting from the bottom end of bar 188 and the two lugs 192 projecting from the respective top and bottom ends of bar 190 and the respective other three hollow members 164, 166 and 168 is essentially the same. Each lug 192 is preferably made of square stock steel material. Each bar 188, 190 preferably includes at least one reinforcing shaft 196 (FIG. 13), which extends substantially along the entire length of the corresponding bar 188, 190, for enhancing the resistance of the corresponding bar 188, 190 to being cut, thereby enhancing the security of the rack 184.

As can be best seen in FIG. 13, the aligned holes 170 and 194 are adapted to receive a substantially U-shaped hasp 120 of locking device 100, which is preferably a key-operable lock. The elongated arms of hasp 120 are adapted to extend through the aligned sets of openings 170 and 194 and into locking device 100 through openings 198. When locking device 100 is locked, lug 192 is secured in locking engagement with hollow member 162. One skilled in the art will recognize that the other three lugs are secured in locking engagement with the respective hollow members 164, 166 and 168 in essentially the same manner.

In accordance with a unique feature of the invention, members 200 and 202 project laterally from respective opposite ends of bar 188. Similarly, members 204 and 206 project laterally from respective opposite ends of bar 190. Each projecting member 200, 202, 204 and 206 has opposed side walls 201 and 203 depending therefrom to define a channel between the corresponding side walls 201 and 203. In effect, members 200, 202, 204 and 206 define substantially C-channel type beams. Each channel is adapted to receive the corresponding hollow member 162, 164, 166 and 168 when the corresponding lug 192 is telescopically received therein. The distal end 205 of each projecting member 200, 202, 204 and 206 is adapted to abut up against front panel member 178, as can be best seen in FIG. 11.

The inwardly facing side wall 201 of each projecting member 200, 202, 204 and 206 has a substantially elliptical aperture 207 to accommodate the insertion of a hasp 120 through holes 170 in the corresponding hollow member 162, 164, 166 and 168, as can be best seen in FIG. 13. The opposite side wall 203 of each projecting member 200, 202, 204 and 206 has a substantially U-shaped notch 209, to accommodate the insertion of a lock key (not shown) into a key hole 211 of lock 100. The beam channel is sufficiently wide to accommodate the entire locking device, including hasp 120 and the entire lock body 100, within the channel, to inhibit cutting of lock 100. Lock 100 is inserted in the beam channel from underneath.

As can be best seen in FIG. 11, when lugs 192 are in mating engagement with the respective hollow members 162, 164, 166 and 168, respective distal end portions of support pins 60 and 62 are in abutting relationship with respective locking bars 188 and 190, or in close proximity thereto, to substantially inhibit access to the respective distal end portions of pins 60 and 62.

When gun rack 184 is fully assembled and secured, as shown in FIG. 11, a plurality of guns 68 may be mounted in substantially horizontal positions, with each gun 68 being supported by a cooperating pair of support pins 60 and 62. Corresponding locking devices secure bars 188 and 190 in respective locking positions for covering the respective support pins 60 and 62. Therefore, a gun 68 mounted on rack 184 cannot be removed therefrom by sliding gun 68 off the ends of the corresponding support pins 60 and 62 without disengaging lugs 192 from the respective hollow members 162, 164, 166 and 168. Disengagement cannot be readily accomplished by cutting the locking devices securing the lugs in mating engagement with the respective hollow members because the locking devices are received within the respective channels of projecting members 200, 202, 204 and 206 and therefore not accessible to cutting or tampering.

Various embodiments of the invention have now been described in detail. Since it is obvious that many changes in and additions to the above-described preferred embodiment may be made without departing from the nature, spirit and scope of the invention, the invention is not to be limited to said details, except as set forth in the appended claims.

I claim:

1. A gun, rack, comprising, in combination:

a frame having gun barrel support means and gun trigger guard receiving means projecting from said frame for supporting a gun in a substantially horizontal position;

mounting means for mounting said frame with a vertical mounting surface;

first securing means projecting from said frame, said first securing means including a hollow member having opposed sides with first and second holes in the respective opposed sides of said hollow member; and second securing means engageable with first securing means, said second securing means including a first member having a lug projecting therefrom, said lug having opposed sides with third and fourth holes in the respective opposed sides of said lug, said lug being telescopically receivable within said hollow member, with the respective first, second, third and fourth holes in transverse axial alignment for receiving a hasp of a locking device, whereby said lug is secured in locking engagement with said hollow member, said second securing means further including a second member projecting laterally from said first member, said second member having a channel for receiving said hollow member when said lug is telescoped within said hollow member.

2. The gun rack of claim 1 wherein said channel is configured to substantially completely receive a locking device used to secure said lug to said hollow member, thereby substantially inhibiting unauthorized access to the locking device.

3. The gun rack of claim 2 wherein said second member has opposed side walls defining said channel, said opposed side walls having respective first and second apertures, said first aperture being adapted to accommodate the insertion of a hasp of the locking device, said second aperture being configured to accommodate insertion of a key into a key hole in the locking device.

4. The gun rack of claim 1 wherein a distal end of said second member is positionable in abutting relationship with said frame when said lug is secured in locking engagement with said hollow member.

5. The gun rack of claim 1 wherein said hollow member has first and second pairs of holes in the respective opposed sides of said hollow member and said lug has third and fourth pairs of holes in the respective opposed sides of said lug, said lug being telescopically receivable within said hollow member to align respective holes of the third and fourth pairs with respective holes of the first and second pairs in transverse axial alignment for receiving a substantially U-shaped hasp of a locking device, to secure said lug in locking engagement with said hollow member.

6. The gun rack of claim 5 wherein said second member has opposed side walls defining said channel, said opposed side walls having first and second apertures, said first aperture being elongated along an axis parallel to a major axis of said lug such that said first and third pairs of holes are accessible through said first aperture when said lug is telescoped within said hollow member, said second aperture being configured to accommodate the insertion of a key into a key hole of the locking device.

7. The gun rack of claim 1 wherein said frame is substantially rectangular and said first securing means includes first, second, third and fourth hollow members adjacent respective first, second, third and fourth corners of said frame, said second securing means including first and second elongated bars, each bar having a lug projecting therefrom adjacent each end of the corresponding bar and a beam projecting laterally from each end of the corresponding bar, said beam having opposed side walls defining a channel, each lug being received within the channel of the corresponding beam, the lugs of said first bar being telescopically receivable within said first and second hollow members and being engageable in locking engagement therewith, the lugs of said second bar being telescopically receivable within said third and fourth hollow members and being engageable in locking engagement therewith, said first and second hollow members being receivable within the respective channels of the beams of said first elongated bar when the lugs of said first elongated bar are telescopically received within said first and second hollow members, said third and fourth hollow members being receivable within the respective channels of the beams of said second elongated bar when the lugs of said second elongated bar are telescopically received within said third and fourth hollow members.

8. The gun rack of claim 7 wherein said frame includes first and second laterally spaced uprights, said gun barrel support means including a plurality of first support pins vertically spaced along said first upright, said trigger guard receiving means including a plurality of second support pins vertically spaced along said second upright, each of said first support pins being adapted to cooperate with one of said second support pins which is laterally spaced from the corresponding first support pin, for supporting a gun in a substantially horizontal position, said first bar being positionable in proximate relationship with respective distal ends of said plurality of first support pins and said second bar being positionable in proximate relationship with respective distal ends of said plurality of second support pins, to inhibit removal of a gun supported by selected ones of said first and second support pins from said rack.

* * * * *